US010852104B2

(12) United States Patent
Aslin

(10) Patent No.: US 10,852,104 B2
(45) Date of Patent: Dec. 1, 2020

(54) RIFLE SCOPE AND MOUNT SYSTEM

(71) Applicant: James David Aslin, North Bend, OR (US)

(72) Inventor: James David Aslin, North Bend, OR (US)

( * ) Notice: Subject to any disclaimer, the term of this patent is extended or adjusted under 35 U.S.C. 154(b) by 0 days.

(21) Appl. No.: 16/510,054

(22) Filed: Jul. 12, 2019

(65) Prior Publication Data

US 2020/0025521 A1 Jan. 23, 2020

Related U.S. Application Data

(63) Continuation-in-part of application No. 16/043,030, filed on Jul. 23, 2018, now Pat. No. 10,352,658.

(51) Int. Cl.
*F41G 11/00* (2006.01)

(52) U.S. Cl.
CPC ..... *F41G 11/003* (2013.01)

(58) Field of Classification Search
CPC ..... F41G 11/001–003
See application file for complete search history.

(56) References Cited

U.S. PATENT DOCUMENTS 2,715,275 A 8/1955 Kipp
4,255,013 A * 3/1981 Allen ..... F41G 1/38 356/247
5,035,487 A 7/1991 Herz
6,123,363 A * 9/2000 Burgard ..... E21B 17/0426 285/24
6,295,754 B1 * 10/2001 Otteman ..... F41G 1/38 42/111
9,759,924 B2 9/2017 Culp
9,915,502 B2 3/2018 Albright
2008/0022576 A1 * 1/2008 Epling ..... F41G 1/38 42/124
2010/0024276 A1 * 2/2010 Kellis ..... F41G 11/001 42/124
2018/0195835 A1 * 7/2018 Crispin ..... F41G 1/30

OTHER PUBLICATIONS

Burris Company, 331 E. 8th Street, Greeley, Colorado 80631 "XTR Signature Rings" (Product Information web page) https://www.burrisoptics.com/mounting-systems/rings/xtr-signature-rings.
Burris Company, 331 E. 8th Street, Greeley, Colorado 80631 "Eliminator III Laser Scope" (Product Information web page) https://www.burrisoptics.com/scopes/eliminator-iii-laserscope.

* cited by examiner

*Primary Examiner* — Charlie Y Peng

(57) ABSTRACT

A rifle scope and mount system provide a means of securely attaching a telescopic sight to a firearm such that a person installing the scope may set it at an appropriate eye relief distance at any of a number of finely spaced apart locations ahead of the shooters head and sighting eye. The scope and mount system also provides means for radial positioning of a scope within its clamp rings so that a local angular discrepancy in the alignment of horizontal datums established by the rifle as held by a user and local horizontal datums established by a mounting rail or similar scope mounting features on the rifle may be overcome by an affordance for securing the scope at an angular displacement substantially equal and opposite to the discrepancy inherent within the weapon.

9 Claims, 4 Drawing Sheets

RIFLE SCOPE AND MOUNT SYSTEM

CROSS-REFERENCE TO THE RELATED APPLICATION

This non-provisional application is a continuation in part of US non-provisional utility patent application Ser. No. 16/043,030, "Rifle Scope and Mount Assembly," filed 23 Jul. 2018 and currently pending. That parent application claims the benefit of priority to U.S. provisional patent application 62/669,512 "Rifle Scope and Mount Assembly" filed 10 May 2018. The entire content of U.S. non-provisional patent application Ser. No. 16/043,030, "Rifle Scope and Mount Assembly" filed 23 Jul. 2018 and the entire content of U.S. provisional patent application 62/669,512 "Rifle Scope and Mount Assembly" filed May 10, 2018, are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to a rifle scope and means for securely attaching it to a rifle.

BACKGROUND

Various firearms have been enhanced by optical telescopic sights or scopes mounted to the weapon by attachment systems employing split-clamping rings.

A recurring problem of is the shifting of the scope due to the forces of inertia generated by the recoil of the firearm's discharge. If the scope shifts, the impact point on the target may also shift, degrading the precision and accuracy of the firearm. The clamping action of most split-ring type mounts uses friction generated by the clamping force applied by the ring to the smooth, cylindrical telescope body tube.

Another problem encountered by users of firearm mounted telescopic sights encounter is the alignment of the telescope with the firearm's bore: at the time when a scope is mounted the rotational alignment of the scope about the scope's longitudinal axis is established, and once the scope is zeroed-in it is desirable that this alignment not be perturbed.

Yet another problem encountered by firearm users is that the a mounting rail system installed on a rifle may establish a local horizontal datum which is out of alignment with other features such as grip sites by which a user typically establishes a primary horizontal reference for the weapon in relation to its environment.

Besides horizontal, vertical, and radial alignment and the demands of secure attachment of a scope to a rifle, a shooter needs to be able to fix the scope onto the rifle at an appropriate distance ahead of where the shooter's head rests when looking through the scope to aim the rifle at a target. Since this ideal distance may sometimes be less than an inch or only a few inches, a gun having heavy recoil can be thrust backward and the rear rim of the scope can strike the shooter in the forehead and even lacerate the skin above the eye pinched between the scope rim and the shooter's skull. The consequence of "scope bite," as this is called, can range from a minor blunt force inconvenience to a substantial injury including bleeding.

BRIEF SUMMARY OF THE INVENTION

A primary objective of the invention is to provide a means of securely attaching a telescopic sight (i.e, a scope) to a firearm such that typical impacts, transit shocks, and the recoil from firing the weapon do not perturb the precise alignment relationship between the axis defined by the bore of the weapon and the precisely adjusted optical components inside the telescopic sight.

Another objective of the invention is to allow a person installing a scope to set it at an appropriate position on the gun, ahead of a place on the rifle where shooter's head rests while aiming. A corollary objective is to be able to mount the scope at a number of axially displaced positions substantially parallel to the shooting axis of the weapon.

Another corollary objective of the invention is to provide a built-in alignment system to at least grossly align the sighting axis of the scope with an axis defined by its mount blocks, even though it is positioned at any of said axially displaced positions substantially parallel to the shooting axis of the weapon.

Yet another corollary objective of the invention is to provide a means for radial positioning of a scope within its clamp rings so that a local angular discrepancy in the alignment of horizontal datums established by the rifle as held by a user and local horizontal datums established by a mounting rail or similar scope mounting features on the rifle may be overcome by an affordance for securing the scope at an angular displacement substantially equal and opposite to the discrepancy inherent within the weapon.

A summary objective of the invention is to provide joints between the scope, mount blocks and the rifle which when clamped, positively eliminate any longitudinal and radial clearances between their respective parts so as to prevent the scope from shifting either longitudinally or radially and to maintain a rigid and consistent mounting, while allowing for removal and repositioning of the scope and its mount blocks within a range of longitudinal locations on a rifle having a mounting rail system.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1A:
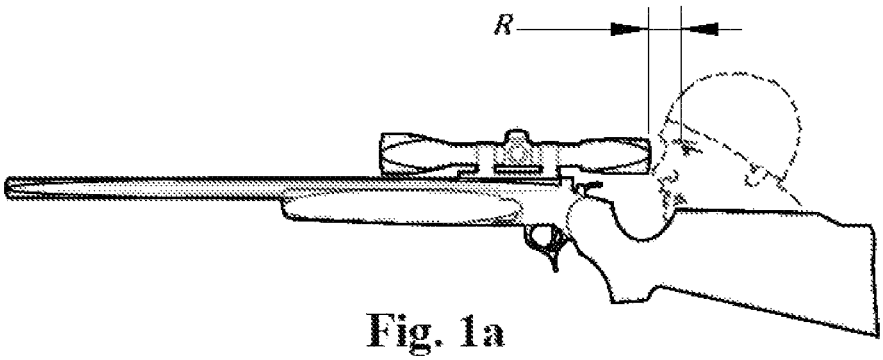
FIG. 1*a* illustrates an eye relief dimension for a shooter holding a scoped rifle.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification, the verb to "zero," to "zero-in, or to "sight in" a scope or a gun equipped with a scope means the act of making adjustments to the internal sighting components and the reticle within a scope affixed to a rifle, so that a bullet discharged by the gun while the sight picture is aligned with a target point of a known distance will, notwithstanding perturbations in flight, strike at or near that predetermined target point within an acceptable deviation. Once a gun is sighted in, at a given range, calculations and compensations may be made which enable similarly accurate shooting at targets of different distances and elevation, and further compensations may be calculated for cross winds, air temperature, and density, and for long distances even the Coriolis effect may be calculated to compensate for the rotation of the earth while the bullet is in flight.

This specification is written in accordance with 20$^{th}$ century American Standard English grammar. In cases of words or pronouns having grammatical gender, which may or may not be related to biological sex, the masculine grammatical gender subsumes the feminine grammatical gender. Thus the pronouns "he," "his," and "him" may be interpreted to stand for "she," "her," "hers" and "her." Plural forms "we," "they," and "them" shall always be taken to refer to pluralities of persons. A "user" or a "shooter" may be a person of any gender or sex. The words "rifle," "firearm," and "gun" are used interchangeably in this specification. Also, this specification assumes US customary units for all quantities of measurement unless otherwise specified.

Also in this specification, terms such as "substantially equal to" or "substantially the same as" indicate pairs or sets of values, parameters, or figures in which the larger or largest of the set is within 5% greater than the smaller or smallest value within the set of values, parameters, or figures.

The invention is a scope and mount block assembly for a rifle, which includes a scope having one or more linear arrays of apertures in its scope tubes, mount blocks which include means for clamping to a mounting rail, such as means adapted for engagement with a Picatinny mounting rail.

Each scope mount, of which two are most commonly provided, comprises a mount block, a clamp member, and a rail clamp. A keyseat in a mount block receives an insert which includes at least one pin, and at least one aperture from among the linear arrays of apertures of the scope seat atop of and receive the pin or pins. Although at least one mount block receives an insert having at least one pin, and other mount blocks may not necessarily include means for receiving an insert, more than one such insert-receiving mount may be affixed to the rifle so that apertures among more than one linear array of apertures in the tubes of the scope may seat upon pins carried by or integral to more than one insert installed in more than one mount block.

Referring now to the figures, FIG. 1*a* illustrates an eye relief dimension [R] for a shooter holding a scoped rifle. Since this ideal distance may sometimes be less than an inch or only a few inches, a gun having heavy recoil or held by a person lacking the body strength to restrain the gun may be thrust backward and allow the rear rim of the scope to strike the shooter in the forehead and even lacerate the skin above the eye pinched between the scope rim and the shooter's skull. Shooters who are aware of how a gun may recoil while within their grip desire to locate a scope at a distance where the risk of "scope bite" is minimized but also where the distance from the sighting eye to the visual aiming aids within the scope may be seen clearly. This optimal distance varies depending on the focal characterstics of the shooters eye and shooters prefer an ability to adjust this [R] dimension as finely as possible as their vision may change over time.

Another problem shooters may seek to overcome occurs where the horizontal plane of the mounting rail or other mounting system is not installed or manufactured to be perpendicular to a vertical plane of the bore, so that angular misalignment may exist between a horizontal siting aid within the scope and the horizon or a horizontal reference within the shooting environment.

Figure 1B:
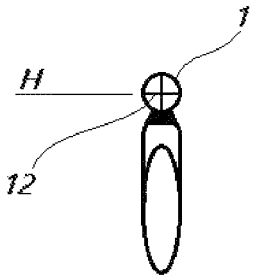
FIG. 1*b* shows a rear view of a rifle with a scope having a horizontal portion of its reticle properly aligned.

FIG. 1*b* shows a rear view of a rifle with a scope [1] having a horizontal portion of its reticle properly aligned. A horizontal portion of the sighting aid within the scope, such as a reticle [12] in this case is parallel to or in alignment with the horizon or a horizontal reference within the shooting environment as represented by horizontal line [H.]

Figure 1C:
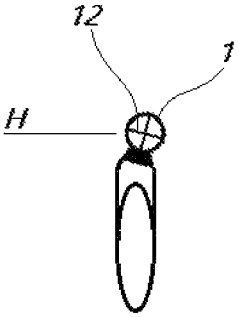
FIG. 1*c* shows a rear view of a rifle having a manufacturing error in horizontal datums of its scope mount features.

FIG. 1*c* shows a rear view of a scope [1] mounted onto a rifle having a manufacturing error in horizontal datums of its scope mount features. In such a situation where the scope mounting system is not perpendicular to the vertical plane of the bore, the angular misalignment between horizontal portion of the sighting aid [12] within the scope versus the horizon or a horizontal reference within the shooting environment [H] may distract from or perturb a shooters attempt to aim and shoot the rifle as accurately as possible and defeating its maximal utilities.

Figure 1D:
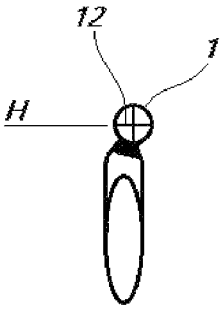
FIG. 1*d* shows a rear view of a rifle having a manufacturing error in horizontal datums of its scope mount features, but with a radial compensation of the horizontal portion of the reticle of a scope mounted to the rifle.

FIG. 1*d* shows a rear view of a rifle which, although having a manufacturing error in horizontal datums of its scope mount features, includes means for radial compensation of the horizontal portion of the reticle [12] of a scope [1] mounted to the rifle, so that horizontal references within the scope now comport with the horizon or a horizontal reference within the shooting environment [H.]

Figure 2A:
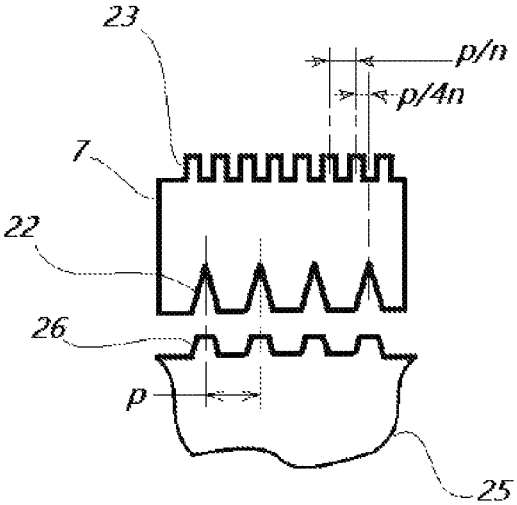
FIG. 2*a* shows a mount block being fit onto a rail mount system having spaced-apart features.

As a review, FIG. 2*a* shows a mount block [7] in accordance with the parent application being fit onto a standard rail mount system having spaced-apart features, such as a standard rail system mounted on or integral to a firearm [25.] The standard rail system has a set linear spaced apart array of positive features extending in an axial direction related to the shooting axis of the firearm. Conversely, a standard rail system may have grooves or slots cut into the firearm or a rail component mounted to it, and the underside of the scope block would have complementary protuberances or lands adapted to engage with the grooves or slots.

To change the location of the scope in an axial direction defined by the scope and mount block assembly, the mount blocks may be moved forward or rearward by a desired amount and then replaced into the mount blocks so the scope's ribs (of the parent application) intermesh with complementary grooves of the mount blocks, and then the lands of the scope seat upon the lands of the mount blocks. The clamp members are then reinstalled and the assembly is re-clamped, completing the installation and adjustment. The scope may be located fit anywhere that both mount blocks engage the features of the mounting rail system.

Furthermore, where the mating features of the mount block may be made symmetrical in planes transverse to the longitudinal direction of the mounting system, the mount blocks may be reversed end for end and still engage the mounting rail to equal effect. These planes of symmetry are illustrated by centerlines in this figure and others where the planes are perpendicular to the page surface and to the axis of the rifle bore.

In this example the mounting rail system features [26] are spaced apart at a pitch of p in the figure. The underside of the mount block has a spaced apart array of notches [22] or protuberances complementary to the rail system features, so these too are spaced apart to define a longitudinal pitch p. The first portion of the mount block has spaced apart features [23] complementary to and adapted to receive the ribs and lands of a ribbed scope of the parent invention. However, the pitch p/n of these engagement features are preferably an integer fraction of the rail system pitch p, where the value n may be 1, 2, 3, 4, 5, or 10 so as to establish a desired ratio of discrete longitudinal location points for the mount block upon the rail versus discrete longitudinal location points for the scope mounted into the mount block. The value of p/n may also be any other figure for the purpose of enabling incremental adjustment of eye relief for a scope mounted on a rifle.

For scope mount systems in accordance with the invention or the parent invention, and wherein n is an integer value, if a feature centerline of the underside groove and land set is aligned with a centerline of the upper groove and land set [23,] then all other centerlines of the underside feature set will also align with a centerline of the upper groove set.

With the option of reversibly affixing mount blocks to a mounting rail understood, it is also possible to offset the upper groove and land system [23] from the underside system [22] by a length dimension. If this is done, then mounting the mount block in a forward facing orientation will advance the scope by the offset length, and mounting the block in a rearward facing orientation will rearwardly displace the block (reducing an eye relief distance) by that offset dimension. In a preferred embodiment as shown in the figure, the offset is p/4n, which means one quarter of the pitch of the upper ribbing and groove intermating system [23] of the invention or of the parent invention. Using this offset, the spacing of the set of incremental positions available for the scope with respect to the rest of the rifle becomes half that of the upper pitch value.

Figure 2B:
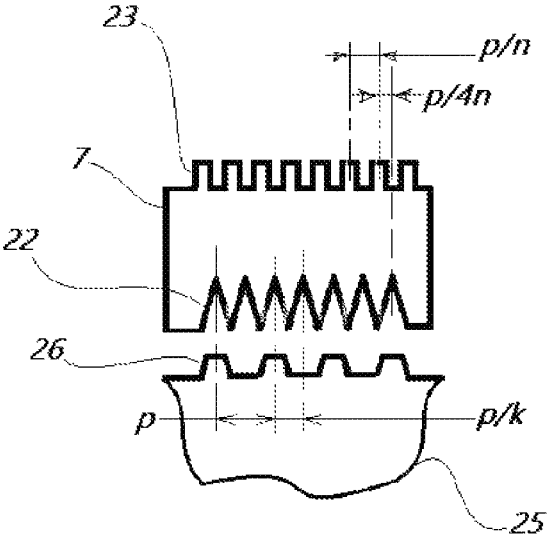
FIG. 2*b* shows a mount block of an alternative embodiment being fit onto a rail mount system having spaced-apart features.

FIG. 2*b* shows a mount block [7] of an alternative embodiment being fit onto a standard rail mount system having spaced-apart features [26] of the mounting rail system on the rifle [25.] In this mount block the pitch of the underside mating features [22] of the mount block equals the pitch p of the standard rail mount system is divided by an integer k so that the position of the mount block on the standard rail mount may be adjusted by a finer increment p/k. The upper groove system [23] of this block operates the same as described in FIG. 3*a* using repeated features spaced apart on a pitch p.

Another advantage of this system is that where n is an integer, then a ribbed scope of the parent invention having ribs spaced on any integer multiple of p/n may mesh with the upper groove and land set [23.] Finer pitches may be used, but practical considerations limit the selection to groove and land forms and sizes that will resist damage from use while still assuring positive engagement of the scope and to its mount blocks and of the mount blocks to the mounting rail system of the rifle. As explained for FIG. 2*a*, an offset between a plane of symmetry of an underside mounting feature [22] of the mount blocks system and a plane of symmetry of the topside mounting features which engage with the scope may be selected to be an offset distance p/4n so that the spacing of the set of incremental positions available for the scope with respect to the rest of the rifle becomes half that of the upper pitch value.

Figure 3:
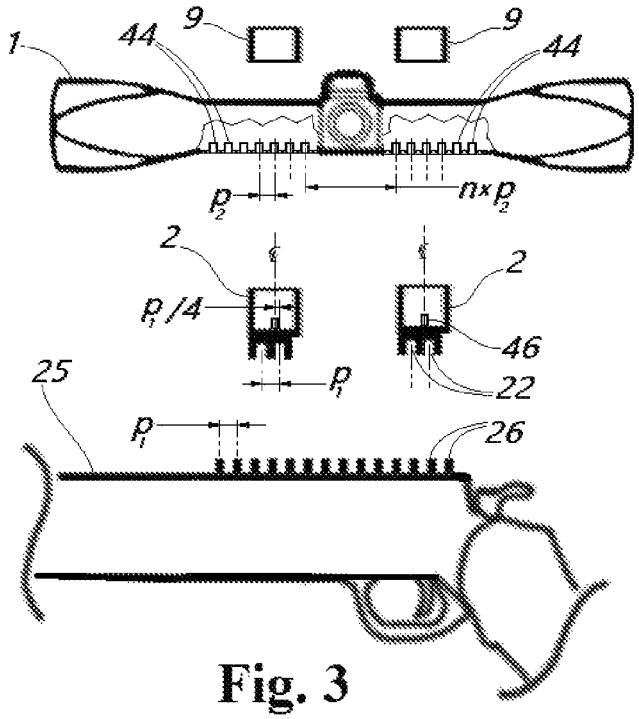
FIG. 3 shows a cross section of an embodiment of a scope and mount system in accordance with the invention.

For further review, FIG. 3 shows a cross section of a scope and mount system also in accordance with the parent invention. A scope is attached to a standard rail which may be a MIL-STD-1913 Picatinny rail or any other sort of standard accessories rail. Two scope mounts [2] are clamped to the rail and receive the scope. Scope clamp members [9] attach to the mount blocks and trap the scope between them. The scope mounts include a linearly spaced apart set of engagement features [22] which mate with spaced apart features [26] of a mounting rail system of a firearm [25.]

The mounting features on the firearm are spaced apart on a pitch $p_1$, and the set of spaced apart engagement features of the mount blocks in this figure are also spaced apart on the same pitch $p_1$, although as explained in FIG. 2*b* the spacing these features along a pitch which is an integer fraction of $p_1$ is also within the scope of the invention. A scope or telescope sight is typically manufactured to include at least two straight cylindrical tube sections, and a scope manufactured in accordance with the invention further comprises in least one or preferably both tubes each a linear array of apertures [44.] The set or sets of apertures in the scope tubes are themselves spaced apart along a pitch $p_2$, which according to a preferred embodiment is an integer fraction of the pitch $p_1$ of repeated features of the mounting rail system.

Where two scope tubes of a scope each include linear arrays of apertures where the pitch of the apertures on the underside of the scope is $p_2$, the spacing between the last aperture of one linear array of holes in a first tube and the first aperture of the next linear array of holes in a second tube is preferably a distance n times the pitch $p_2$ ($n \times p_2$) where n is an integer.

The scope-receiving sites of the mounting blocks include at least one pin [46] sized to fit snugly into the apertures [44] in the scope tubes. As explained for FIG. 2*a*, an offset between a plane of symmetry of an underside mounting feature [22] of a mount block and an axis of a pin in the scope-receiving site of the mounting block may be selected to be an offset distance $p_1/4$ so that the spacing of the set of incremental positions available for the scope with respect to the rest of the rifle becomes half that of the pitch $p_1$ of repeated features of the mounting rail system.

Figure 4:
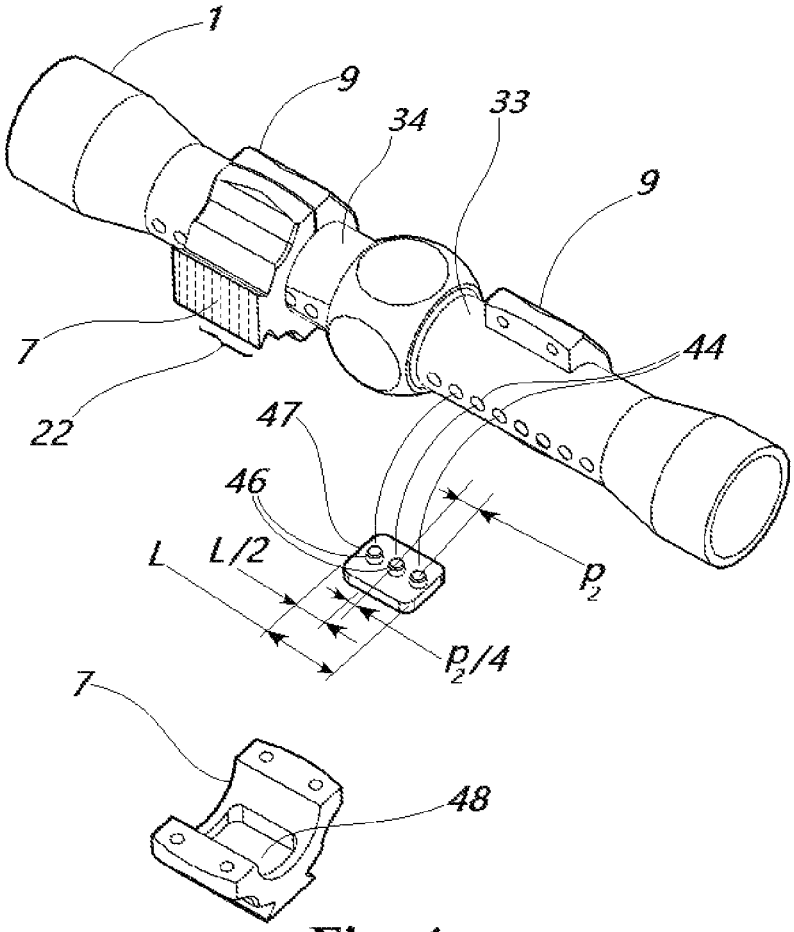
FIG. 4 shows components of an embodiment of a scope and mount block assembly in accordance with the invention.

FIG. 4 shows components of an embodiment of a scope and mount block assembly in accordance with the invention. A scope [1] has at least a first scope tube [33] and preferably a first and may also include a second scope tube [34] of which at least the first scope tube includes a linear array of apertures [44.] At least two mount blocks [7] include linearly spaced apart set of engagement features [22] which mate with spaced apart features of a mounting rail system of a firearm, and as also described and shown previously, the mount blocks are reversibly mountable onto the mounting rail system.

The telescope sight mounting system also includes split-ring clamp members [9] which are drawn down onto the mount blocks my means such as screws (not shown) for clamping the scope between the clamp members and the mount blocks to form a friction grip on the scope. By careful configuration the inner diameters of the mount blocks and clamp members, a clamp joint with an interference fit may be established which eliminates all axial and radial clearance. The mount blocks of the invention include a pocket [48] which receives an insert [47] having a longitudinal length L and a plane of symmetry at its midplane which is a distance L/2 from either of its longitudinal ends. The longitudinal length of the pocket is also substantially equal to L except for clearances or interferences required for a close fit or a snug fit.

The insert includes at least one pin [46] sized to be received into the apertures of the scope tubes, and laterally centered on the insert. The pins may be pressed into holes made in the insert or the insert and its pins may be machined or forged from a single mass of material. Where more than one pin is present they are spaced apart on a pitch $p_2$ and at least one pin is located either ahead of or abaft of the midplane located at L/2 from either longitudinal end of the insert by an offset distance. A preferred offset distance is $p_2/4$ so that with the insert reversibly insertable into the pocket of the mount block the scope, with its scope tube apertures engaging the at least one pin of the insert, may be located either ahead of or abaft of the midplane of the mount block transverse to the rifle, as a fine adjustment of eye relief for the scope as installed on the rifle.

A particular preferred embodiment sets $p_2$ to be one-half of $p_1$, so that for a standard mounting system such as the MIL-STD-1913 Picatinny rail whose pitch $p_1$ is 10 mm, the midplane of the mount block pocket transverse to the rifle bore is offset by $p_1/4=2.5$ mm so that the location of that midplane with respect to a reference transverse plane of the mounting rail system may be incremented in 5 mm intervals along the mounting rail by affixing the mount block to the mounting rail in a forward or reversed orientation. Then, the pitch of the apertures in the scope tubes is set preferably at $p_2=p_1/2=5$ mm, and the offset of the pin axis with respect to the transverse midplane of the insert is $p_2/4=p_1/8=1.25$ mm, so that location of a pin axis with respect to the reference transverse plane of the mounting rail system may be incremented in 2.5 mm intervals along the mounting rail by orienting the insert within the pocket of the mount block in its own forward or reversed orientation.

As an additional example of an alternative preferred embodiment has both pitches the same while the first and second offsets are different. For this preferred example, $p_1$ and $p_2$ are both 10 mm, but the first offset between the midplane of the mount block pocket transverse to the rifle bore is offset by $p_1/4=2.5$ mm so that the location of that midplane with respect to a reference transverse plane of the mounting rail system may be incremented in 5 mm intervals along the mounting rail by affixing the mount block to the mounting rail in a forward or reversed orientation. The second offset is $p_1/8=p_2/8=1.25$ mm, so that location of a pin axis with respect to the reference transverse plane of the mounting rail system may be incremented in 2.5 mm intervals along the mounting rail by orienting the insert within the pocket of the mount block in its own forward or reversed orientation.

Also in accordance with the invention is an embodiment similar to that shown in FIG. 2*b*, wherein the pitch of the underside features in the mount block which engage the repeated features of the Picatinny rail are instead spaces apart an integer fraction of its 10 mm pitch. For example, with k=3 the pitch of the underside features of the mount block becomes $p_1/k=p_1/3=3.333$ mm. The offset of the transverse midplane of the pocket preferably becomes $p_1/4$ k=0.833 mm. Then the pitch of the aperture arrays in the scope tubes preferably becomes $p_2=p_1/2$ k=1.667 mm, and the offset of the insert pin axis with respect to the transverse midplane of the insert preferably becomes $p_2/4=p_1/8$ k=0.416 mm, so that location of a pin axis with respect to the reference transverse plane of the mounting rail system may be incremented in 0.833 mm intervals along the mounting rail by orienting the insert within the pocket of the mount block in its own forward or reversed orientation. Thus with even low values for k, extremely fine adjustments to eye relief may be achieved as fractional increments of the base pitch of the mounting rail system. Any axial location preference which does not exactly reside within the defined set of these finely spaced discrete locations may be reasonably accommodated by the shooter moving his or her head by the slight, remaining non-integer fraction of the defined pitch. The burden of this slight accommodation for discrete axial positioning options for the scope is more than overcome by the benefits of a robust and slip-proof scope mounting system.

Figure 5:
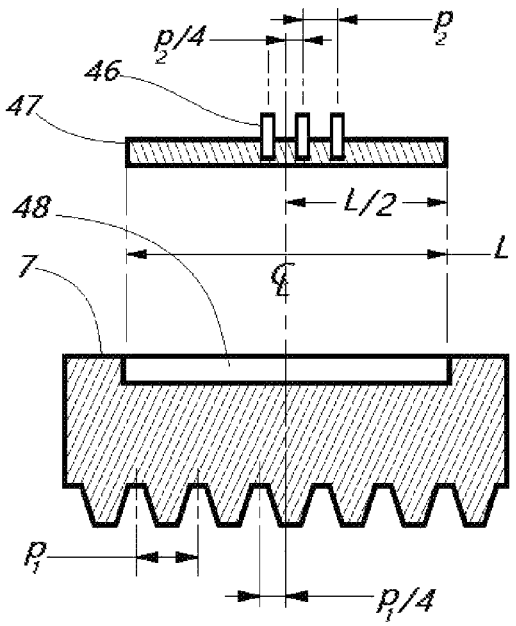
FIG. 5 shows cross section of a mount block and insert in accordance with the invention.

FIG. 5 shows cross section of a mount block and an insert accordance with the invention. The underside of the mount block has a spaced apart array of protuberances or notches or other repeated features complementary to the mounting rail system features which are spaced apart along a longitudinal pitch $p_1$ which may equal a pitch p of the standard rail mount system, or may be divided by an integer k so that the position of the mount block on the standard rail mount may be adjusted by a finer increment $p_1=p/k$.

The features which engage the mount block to the rail are made symmetrical in planes transverse to the longitudinal direction of the mounting system so that the mount blocks may be attached to the mounting rail system in both a forward facing orientation and a rearward facing orientation rotated 180° from the forward facing orientation and achieve an equally secure grip onto the mounting rail system. These planes of symmetry are illustrated by centerlines in this figure and others where the planes are perpendicular to the page surface and to the axis of the rifle bore.

As explained in FIG. 4 above, the mount blocks of the invention also include a pocket [48] having a longitudinal length L, which receives an insert [47] having a longitudinal length substantially equal to L except for clearances or interferences required for a close fit or a snug fit. A plane of symmetry at a midplane of the pocket is defined at a distance L/2 from either of its longitudinal ends, and a similar plane of symmetry is defined at a midplane of the insert at a distance L/2 from either of its longitudinal ends. The midplane of the pocket is displaced by an offset from a centerline of any centrally located or nearly centrally located instance of the spaced apart array of protuberances or notches or other repeated features on the underside of the mount block and complementary to the mounting rail system of the rifle. Where the pitch of these repeated features is $p_1$, a preferred offset between a feature centerline and the midplane of the pocket is $p_1/4$.

The insert includes at least one pin [46] sized to be received into the apertures of the scope tubes, and laterally centered on the insert. Where more than one pin is present they are spaced apart on a pitch $p_2$ and at least one pin is located either ahead of or abaft of the midplane located at L/2 from either longitudinal end of the insert by an offset distance. A preferred offset distance is $p_2/4$ so that with the insert reversibly insertable into the pocket of the mount block the scope, with its scope tube apertures engaging the at least one pin of the insert, may be located either ahead of or abaft of the midplane of the mount block transverse to the rifle, as a fine adjustment of eye relief for the scope as installed on the rifle. A preferred value for $p_2$ is $p_1/2$.

In summary, an embodiment of a scope and mount block assembly in accordance with the invention comprises a scope which has at least ones tubular section, which defines a longitudinal axis. At least one such tube sections has a plurality of apertures cut into it, and theses apertures having centers spaced apart to define a longitudinal pitch p2. The mount blocks of the assembly include at least one mount block comprising means for reversibly mounting to repeated features on a mounting rail These means may include series repeated instances of tabs, flanged protuberances, studs, slots, notches, or apertures.

The repeated features in turn define a plurality of centerlines spaced apart on a longitudinal pitch $p_1$. A mount block also includes a pocket for receiving an insert which is symmetrical about a midplane perpendicular to the longitudinal axis of the rifle and its mounting system or mounting rail. The insert further comprises a pin which when the insert is received into the mount block pocket, the midplane is spaced apart by a first offset distance from one of said centerlines of said repeated features of said mounting rail. A preferred value for this first offset distance is $p_1/4$. The pin defines a central axis, which while the insert is installed in the mount block pocket is spaced apart by a second offset distance from said midplane of the insert. A preferred value for this second offset distance is $p_2/4$. The pin is also receivable into any of the apertures cut into the tubular section of the scope. Lastly the assembly also includes a clamp member to clamp the scope between itself and the mount block.

Figure 6:
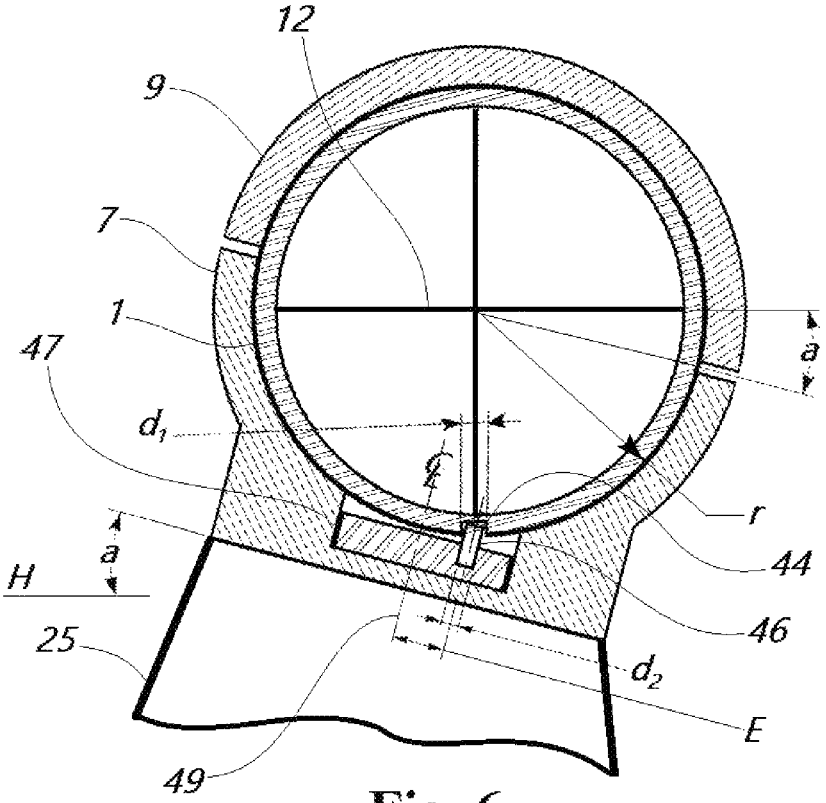
FIG. 6 shows a cross section through a scope and mount block in accordance with the invention demonstrating an angular compensation within the mount block system counteracting a manufacturing error in horizontal datums of scope mount features in a rifle to which it is installed.

FIG. 6 shows a cross section through a scope and mount block in accordance with the invention demonstrating an angular compensation within the mount block system counteracting a manufacturing error in horizontal datums of scope mount features in a rifle [25] to which it is installed. In this case, the local datum which is expected to be horizontal is instead displaced by an angular error [a] away from a horizontal reference represented by the line [H.] It would then be a desirable countermeasure to mount a scope onto the existing mounting rail system so that it acquires an angular offset along its longitudinal axis which is equal and opposite to the angular error of its mount. In this figure the scope [1] is restrained between a clamp member [9] and a mount block [7] with the mount block including a pocket which receives an insert [47] having at least one locating pin [46] which in turn is received into an aperture [44] in one of the scope tubes of the scope. As previously the insert and pin may be machined from a single mass of material, or as is seen in this figure, the insert may include a hole such as a blind hole into which a pin is pressed.

A custom compensating insert may be manufactured using some trigonometry to calculate a lateral offset [E] for the axis of the pin or pins based on the radius [r] of the scope tube and the desired angular compensation angle [a,] with $E=r\sin(a)$. Because the pin enters the locating aperture of the scope obliquely, the pin diameter $d_2$ must be smaller than locating aperture diameter $d_1$ so that $d_2=d_1\cos(a)$. Using this schema the scope may be shifted on its rotational longitudinal axis so that it encounters the top of the pin when horizontal elements [12] of the sight picture of the scope are substantially perpendicular to surfaces and datums of the rest of the firearm which the shooter expects to be held vertical while aiming or shooting, and are also parallel to horizontal elements in the shooting environment, so that the manufacturing misalignment is neutralized.

If desired, it is also possible when using two mount blocks to manufacture their respective inserts to create an offset torque at a first mount block and an equal and opposite the countertorque at a second mount block so that clearance between the insert pin diameter and the aperture diameters can be taken up by laterally pressing the sidewall of a first aperture onto a first pin at a first mount block, and pressing an opposite sidewall of a second aperture onto a second pin at a second mount block so that in concert the pair of opposed torques create a positive locking effect in a radial mode which is analogous to an interference fit of two linear dimensions.

In summary of an embodiment in accordance with the invention designed for angular compensation of skewed horizontal datums in a mounting system of a rifle, a scope and mount block assembly for this purpose may comprise a scope with at least one tubular section defining a longitudinal axis and having a at least one or a plurality of apertures cut into such a tubular section, with the apertures having centers spaced apart to define a longitudinal pitch. A mount block for this system will also include means for reversibly mounting to repeated features on a mounting rail, and these repeated features define at least one horizontal datum and a vertical longitudinal plane [49] perpendicular to that horizontal datum, which contains the longitudinal axis and appears as a centerline [CL] in this figure. The mount block includes a pocket for receiving an insert, and the insert has a pin which when the insert is received into the mount block pocket, the central axis of said pin is laterally offset from the vertical longitudinal plane. The pin is also receivable into any aperture from among the plurality of apertures cut into the tubular section of said scope. The assembly also includes a clamp member to clamp the scope between itself and the mount block.

Figure 7A:
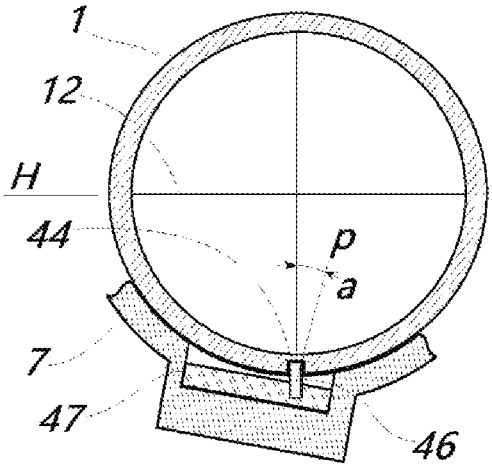
FIG. 7*a* shows a cross section through a scope and mount block in accordance with the invention illustrating an angular compensation scheme which uses an insert having a pin received within an angled hole.

FIG. 7*a* shows a cross section through a scope [1] and a portion of a mount block [7] in accordance with the invention illustrating an angular compensation scheme which uses an insert [47] having a pin [46] received within an angled hole. The hole is drilled at a point laterally offset from a midplane of the insert which is parallel to the axis of the rifle bore. The axis [p] of the hole is tilted at an angle [a] which is equal and opposite to the angular misalignment being corrected, such as a manufacturing error in horizontal datums of scope mount features in the rifle. A scope tube aperture [44] on the underside of a scope seats upon this pin and optional additional tilted pins which may form a linear array which engages with a plurality of the underside apertures in the scope tube. With the angular error substantially corrected, a horizontal portion of the sighting aid within the scope, such as a reticle [12] in this case, is brought parallel to or in alignment with the horizon or a horizontal reference within the shooting environment as represented by horizontal line [H.]

Figure 7B:
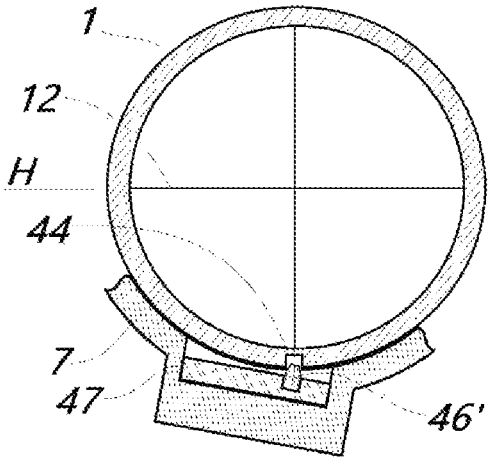
FIG. 7*b* shows a cross section through a scope and mount block in accordance with the invention illustrating an alternative angular compensation scheme which uses an insert having a pin with a conical tapered portion.

FIG. 7*b* shows a cross section through a scope [1] and a portion of a mount block [7] in accordance with the invention illustrating an alternative angular compensation scheme which uses an insert [47] having a pin [46'] with a conical tapered portion. The offset dimension is figured as a trigonometry calculation as described previously, and the taper angle is substantially equal to the compensation angle required to cancel out the angular misalignment being corrected, such as a manufacturing error in horizontal datums of scope mount features in the rifle. With the scope rotated in its mounts by this compensation angle, a portion of the interior wall of an underside aperture [44] in the scope tube rests on the conical portion of the pin as a line contact, and optionally an additional point of contact occurs between a point on the pin and the bottom rim of the hole diametrically opposite the line contact with the pin. The scope is locked against unwanted rotation in its mounts in a first direction by the line contact, and is locked against unwanted rotation in a second, opposite direction by the additional point contact diametrically opposite the line contact. With the scope locked in this angular orientation, the angular error may be substantially corrected, and a horizontal portion of the sighting aid within the scope, such as a reticle [12,] is brought parallel to or in alignment with the horizon or a horizontal reference within the shooting environment as represented by horizontal line [H.]

Also, although the underside apertures are more commonly characterized by cylindrical blind holes, it is also within the scope of the invention that the apertures further comprise lead-in features such as countersunk or filleted rims, and that the interior surfaces of these apertures may also include tapered or conical surfaces substantially complementary to the conical or tapered surfaces on the pin, so that instead of a line contact between the pin and an interior of an underside aperture in the scope tube, the contact interface may also be a two-dimensional membrane area curved in three-dimensional space.

Besides firearms, the invention is suitable for all sorts of projectile sports equipment or hunting tools which benefit from optically assisted aiming means mounted thereto. The invention provides effective means to mount telescopic sights on firearms and other projectile tools securely, reliably, economically, and repeatably, and eliminates the variables of the friction joint in a typical scope to ring assemblage. By applying the details of the invention features as described herein and especially the selection of a first pitch for the repeated features on the mount block complementary to repeated features of the mounting system, and a second finer pitch for the array of apertures on the scope tube which seat upon pins in the mount block. Preferred modes include a second pitch which is an integer fraction of the first pitch, so that for an integer n, $p_1$:$p_2$ may be 1:1/n. Preferred ratios for $p_1$:$p_2$ may include 1:1, 1:1/2, 1:1/3, 1:1/4, 1:1/5, or 1:1/10 or the like.

Also, although "rifle" is mentioned in connection with various sorts of mounting rails commonly affixed to rifles and weapons in general, the invention may be used wherever exceptionally precise alignment of mountable and dismountable parts are required, and especially if the replaceable component comprises a tube which can be anchored at two or more points by means of an array of apertures in the tube engaging a block which includes similar repeated engagement features for mounting onto some other mounting system, and also one or more pins arranged on pitch so that the arrays of holes may be seated upon them for precise location along the direction of the repeated features. When pins of the mount block or of an insert retained therein are received into their complementary apertures, then the objects being mated will relocate to the best-fit center of the entire set of engaged pins and apertures. Radial alignment may also be reestablished or enforced as explained above.

One suitable application is disassembly and reassembly of tubular components such as the plurality of electron guns, particle beams, and other modular elements of smaller sized (desktop) electron microscope apparatus. These tubular modules attached to a high-vacuum chamber and must be removed and replaced regularly. Since these tools must typically be aligned within tolerances ranging with tens of microns, the ability for precise reassembly of the tools saves time and the expensive labor costs consumed by highly trained technicians and engineers who maintain such equipment.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A scope and mount block assembly comprising:

a scope comprising a tubular section defining a longitudinal axis and having a plurality of apertures cut into said tubular section, said apertures having centers spaced apart to define a longitudinal pitch $p_2$, a mount block comprising means for reversibly mounting to repeated features on a mounting rail, said repeated features defining a plurality of centerlines spaced apart on a longitudinal pitch $p_1$, with a pocket for receiving an insert, said insert symmetrical about a midplane perpendicular to said longitudinal axis, said insert further comprising a pin which when said insert is received into said mount block pocket, said midplane is spaced apart by a first offset distance from one of said centerlines of said repeated features of said mounting rail, and a central axis of said pin is spaced apart by a second offset distance from said midplane of said insert, said pin also receivable into an aperture from among said plurality of apertures cut into said tubular section of said scope, and a clamp member, with said scope disposed between said mount block and said clamp member.

2. The scope and mount block assembly of claim 1, wherein said first offset distance is $p_1/4$.

3. The scope and mount block assembly of claim 1, wherein said second offset distance is $p_2/4$.

4. The scope and mount block assembly of claim 1, wherein said mounting rail is a Picatinny rail.

5. The scope and mount block assembly of claim 1, wherein a ratio of $p_1$:$p_2$ of said longitudinal pitches $p_1$ and $p_2$ is 1:1/n, where n is an integer.

6. The scope and mount block assembly of claim 5, wherein said ratio is selected from the set of ratios consisting of:

a 1:1 ratio, a 1:1/2 ratio, a 1:1/3 ratio, a 1:1/4 ratio, a 1:1/5 ratio, and a 1:1/10 ratio.

7. A scope and mount block assembly comprising:

a scope comprising a tubular section defining a longitudinal axis and having a plurality of apertures cut into said tubular section, said apertures having centers spaced apart to define a longitudinal pitch, a mount block comprising means for reversibly mounting to repeated features on a mounting rail, said repeated features defining at least one horizontal datum and a vertical longitudinal plane perpendicular to said horizontal datum and containing said longitudinal axis, a pocket for receiving an insert, said insert further comprising a pin which when said insert is received into said mount block pocket, a central axis of said pin is offset from said vertical longitudinal plane, said pin also receivable into an aperture from among said plurality of apertures cut into said tubular section of said scope, and a clamp member, with said scope disposed between said mount block and said clamp member.

8. The scope and mount block assembly of claim 7, wherein said central axis of said pin resides at an angle to said vertical longitudinal plane.

9. The scope and mount block assembly of claim 7, wherein said pin further comprises a conical surface.

* * * * *